US006835258B2

(12) United States Patent
Bingham et al.

(10) Patent No.: US 6,835,258 B2
(45) Date of Patent: Dec. 28, 2004

(54) AUTOMATED PROCESSES FOR THE PRODUCTION OF GARMENTS

(75) Inventors: Geoff Bingham, Warwickshire (GB); Martin Bentham, South Yorkshire (GB)

(73) Assignee: Sara Lee Corporation, Winston-Salem, NC (US)

( * ) Notice: Subject to any disclaimer, the term of this patent is extended or adjusted under 35 U.S.C. 154(b) by 50 days.

(21) Appl. No.: 10/330,922

(22) Filed: Dec. 27, 2002

(65) Prior Publication Data

US 2004/0123368 A1 Jul. 1, 2004

(51) Int. Cl.[7] ..... B32B 31/00

(52) U.S. Cl. ..... 156/73.3; 156/73.1; 156/272.8; 156/281

(58) Field of Search ..... 156/73.1, 73.3, 156/160, 163, 165, 229, 251, 272.2, 272.8, 281, 308.2

(56) References Cited

U.S. PATENT DOCUMENTS

| | | | | | |
|---|---|---|---|---|---|
| 2,990,088 | A | | 6/1961 | Isken et al. | 223/76 |
| 2,974,838 | A | | 12/1961 | Parham | 223/76 |
| 3,892,342 | A | | 7/1975 | Ogawa et al. | 223/57 |
| 5,040,475 | A | | 8/1991 | Fournier et al. | 112/121.15 |
| 5,165,355 | A | | 11/1992 | Fournier et al. | 112/262.2 |
| 5,393,360 | A | * | 2/1995 | Bridges et al. | 156/73.3 |
| 5,458,265 | A | | 10/1995 | Hester et al. | 223/72 |
| 5,509,985 | A | * | 4/1996 | Kock | 156/160 |
| 5,516,392 | A | * | 5/1996 | Bridges et al. | 156/160 |
| 5,518,566 | A | * | 5/1996 | Bridges et al. | 156/161 |
| 6,178,781 | B1 | | 1/2001 | Myers | 66/8 |
| 6,192,521 | B1 | | 2/2001 | Alberts et al. | 2/227 |
| 6,464,811 | B1 | * | 10/2002 | Meier et al. | 156/71 |

FOREIGN PATENT DOCUMENTS

| | | |
|---|---|---|
| GB | 2 265 077 | 9/1993 |

* cited by examiner

*Primary Examiner*—James Sells
(74) *Attorney, Agent, or Firm*—Ohlandt, Greeley, Ruggiero & Perle

(57) ABSTRACT

An automated process is provided that includes loading a blank on a carrier and moving one of the carrier or the blank to more than one of a number of stations. The carrier has at least a portion with a desired shape that provides the blank with a stretched condition. Each station performs an operation on the blank while the blank is mounted on the carrier.

22 Claims, 2 Drawing Sheets

AUTOMATED PROCESSES FOR THE PRODUCTION OF GARMENTS

BACKGROUND OF THE INVENTION

1. Field of the Invention

The present invention relates to automated processes for the production of garments. More particularly, the present invention relates to automated processes for the production of garments made from circularly knitted or tubular garment blanks.

2. Description of Related Art

Circular knitting processes such as described in commonly owned and assigned U.S. Pat. No. 6,178,781 to Myers have found wide use in the production of seamless tubular garment blanks. Such seamless tubular garment blanks can be used in the production of a variety of clothing items, such as pantyhose, stockings, brassieres, halter type blouses, figure persuasive underwear, vests, tee shirts, briefs and the like.

In the conventional production of garments such as brassieres or briefs from such tubular garment blanks, there are many distinct stages of production, which are usually performed independently and in batches. For example, initially a batch of fabric is knitted, and the batch of knitted fabric in its grey state is then can be stentered and heat set before being transported to a dyeing plant. After the batch of fabric has been dyed and finished, it is then cut to shape to create a batch of blanks, which are subsequently transported to another site for assembly into the final garments.

These different operations are usually performed at different sites, which can be located at great distances from one another and are labor intensive.

In the fashion industry, consumer preference can be difficult to predict, which can make batch production particularly unsuited for the garment industry. For example, batch production processes can require large production changeover times. Namely, the production equipment requires a large amount of time to convert from manufacturing a garment of a first style, such as a brief having a first size, to a garment having a second style, such as a brief having a second size. Thus in batch production, large manufacturing runs are typically scheduled to reduce the downtime associated with such production changeovers.

Large production runs of a particular garment can have one or more undesired results. For example, if demand for a particular garment is lower than expected, then more garments than are needed have been made. The excess garments are either discarded or inventoried, either of which can increase the manufacturer's cost of goods. Alternately, if demand for the garment is higher than expected, then less garments than are needed have been made. Here, unscheduled production runs are needed to meet the increased demand. Unfortunately, these additional production runs in a batch production system can be slow to react to the increased demand and can also lead to an increase the manufacturer's cost of goods. For example, the additional production runs can require unexpected machine changeover and its associated downtime.

Accordingly, there is a continuing need in the garment industry for faster reaction time to consumer demand, but without increasing the manufacturer's cost of goods.

BRIEF SUMMARY OF THE INVENTION

It is an object of the present invention to provide an automated process for the production of garments from a tubular blank in which separate production steps are performed sequentially while the blank is mounted on a carrier.

It is another object of the present invention to provide an automated process that includes loading a blank on a carrier and moving one of the carrier or the blank to more than one of a plurality of stations. The carrier has at least a portion with a desired shape that provides the blank with a stretched condition. Each station performs an operation on the blank while the blank is mounted on the carrier.

According to one aspect of the present invention, there is provided a process for the production of garments which includes: knitting a stretchable fabric to define a tubular blank having a first fabric region defining fabric for a garment, and one or more second, remaining, fabric regions that define waste fabric; transferring the tubular blank onto a movable carrier in the form of a former having a desired shape and stretching the blank on the former to shape the blank into the desired shape; and moving the carrier with the blank thereon sequentially through a succession of operational stations whereat different finishing-type operations are performed on the blank whilst mounted on the carrier in a stretched condition. The finishing-type operations can include a heat setting operation for setting the shape of the stretched blank to the desired shape, and a trimming operation for trimming the blank to separate the regions of garment fabric and waste fabric and thereby define a desired edge profile for the garment fabric, and removing the shaped, and trimmed garment fabric from the carrier and performing, if required, final garment assembly operations thereon.

The above-described and other features and advantages of the present disclosure will be appreciated and understood by those skilled in the art from the following detailed description, drawings, and appended claims

DETAILED DESCRIPTION OF THE INVENTION

Figure 1:
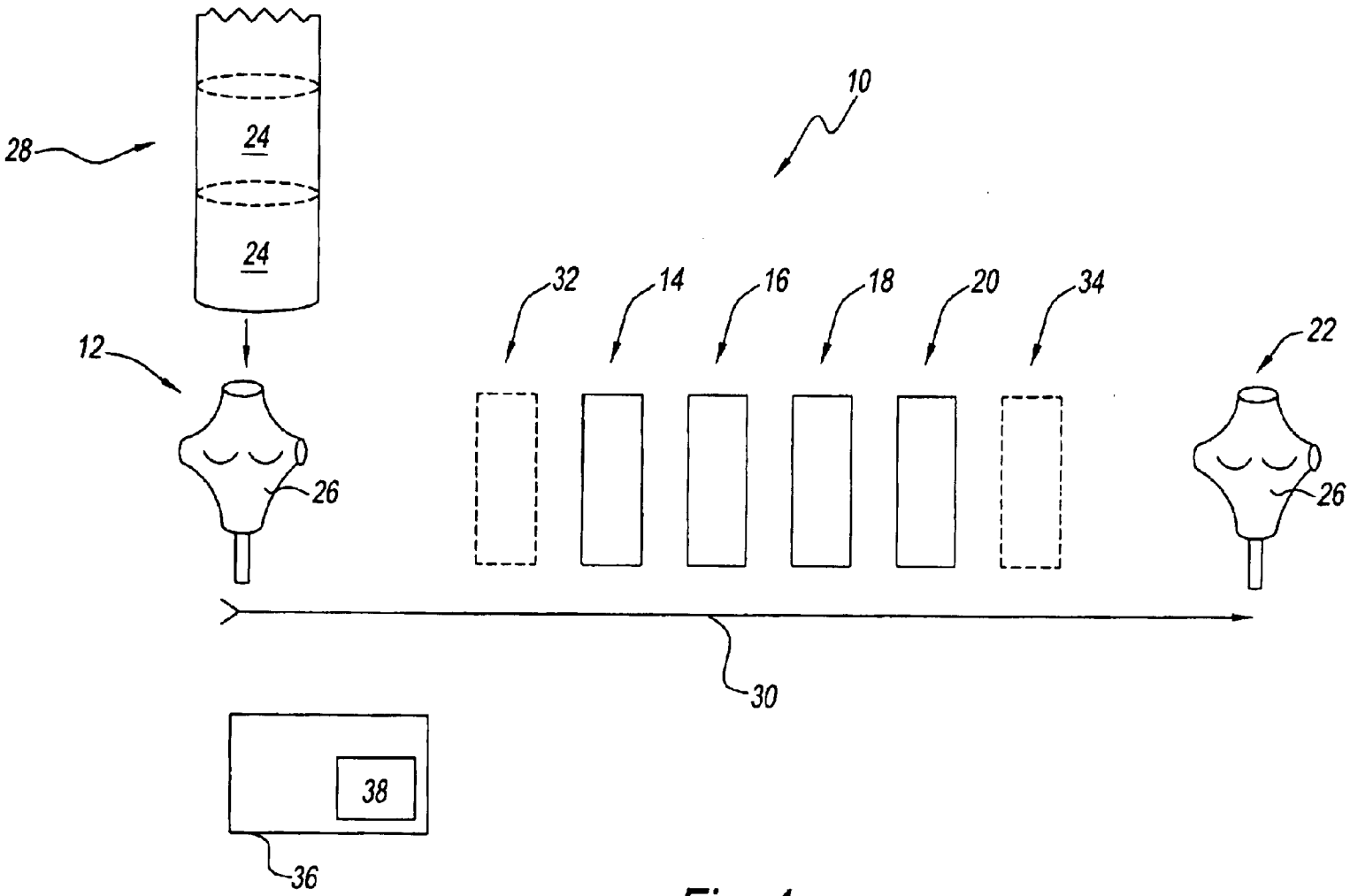
FIG. 1 is a schematic depiction of a first exemplary embodiment of an automated process.

Referring now to the figures, and in particular to FIG. 1, an automated process generally indicated by reference number 10 is illustrated. Automated process 10 includes a number or plurality of stations, where a separate manufacturing step of the finished garment can be performed at each station.

In the illustrated embodiment, the plurality of stations can includes one or more of a first station 12, a second station 14, a third station 16, a fourth station 18, a fifth station 20, and a sixth station 22.

First station 12 provides, preferably by its configuration, for loading a tubular or circularly knitted garment blank 24 onto a carrier 26. For example, blanks 24 can be loaded, one at a time, from a supply 28 of blanks onto carrier 26. Supply 28 can be in any desired form. For example, supply 28 can be a roll of continuous garment blanks, a stack of separate garment blanks, a garment blank manufacturing machine feeding the blanks to carrier 26, and the like. In the example where supply 28 is a continuous supply, blanks 24 are trimmed from the supply before, during, or after the loading of the blank onto carrier 26.

Carrier 26 has a predetermined shape. For example, in the case of producing brassieres, each carrier 26 would, as schematically shown, include a three-dimensional shape replicating the upper torso of a woman having predetermined chest and breast sizes. Of course, it is contemplated by the present invention for carrier 26 to have other predetermined shapes, such as a two-dimensional shape.

Carrier 26 is detachably mounted on a conveyor 30, which sequentially moves the carrier to each of the stations. During automated process 10, garment blank 24 remains on carrier 26 as it moves from station-to-station, an attribute that hereto for was unattainable.

It should be recognized that automated process 10 is illustrated for purposes of clarity only as having one carrier 26 mounted to one conveyor 30. Of course, it is contemplated for process 10 to include more than one conveyor and/or for each conveyor to include more than one carrier 26.

At second station 14, blank 24 is heat set to a desired shape. Since carrier 26 has a predetermined shape, heat applied at second station 14 can set the shape of blank 24 to the shape of the carrier. In addition, cooling of blank 24 after the application of heat can, in some fabrics, further set the shape of the blank. Second station 14 can, preferably due to its configuration, heat set blank 24 using any desired heat setting parameters (e.g., temperature, time, and the like) necessary for the fabric of the blank. Thus, blanks 24 made of different fabrics can be heat set at second station 14 merely by adjusting the heat setting parameters of the second station.

By way of example only, the heat can be applied to blank 24 at second station 14 by moving carrier 26 to a heating chamber at which the stretched blank is exposed to a predetermined elevated temperature. The elevated temperature can induce a desired degree of heat setting in blank 24. Alternately, carrier 26 can, or can be configured to, apply heat to and/or remove heat from blank 24 at second station 14. Further, it is contemplated that heat can be added/removed from blank 24 during the movement of carrier 26 between the first and third stations, respectively.

Since carrier 26 is removably mounted on conveyor 30 and it provides blank 24 with its predetermined shape, automated process 10 can be changed from manufacturing one garment having a first breast cup size to a second garment having a second breast cup size by merely replacing carrier 26. Thus, automated process 10 can reduce the changeover time needed to change from garment-to-garment as compared to previous systems.

Third station 16 trims one or more regions from blank 24 to define the periphery of the finished garment. Third station 16 can trim blank 24 in any manner necessary.

For example, third station 16 can trim blank 24 through the application of heat. Here, blank 24 would have heat degradable yarns incorporated therein. The heat degradable yarns can be incorporated in blank along predefined line(s) that define the outer periphery of the finished garment. Third station 16 adds heat to blank 24 in an amount sufficient to cause the heat degradable yarns to separate and, thus, trim the blank to define the periphery of the finished garment. Alternately, the heat degradable yarns can be incorporated in blank and third station 16 can add heat along predetermined lines to blank 24 in an amount sufficient to cause the heat degradable yarns to separate and, thus, trim the blank to define the periphery of the finished garment.

It is contemplated that the heat applied by second station 14 during the heat setting operation is either sufficient to also perform the trimming operation so that the second and third stations are one station, or sufficient only to perform the trimming operation, as desired.

Alternatively, it is contemplated for third station 16 to trim blank 24 by severing the fabric of the blank. Here, third station 16 has a trimmer or trimming means (not shown) for severing blank 24 along the predefined line(s). The trimmer can include, for example, a blade moved along the predefined line(s) by way of moving the blade and/or carrier 26.

The trimmer can also include an ultrasonic gun or a laser that can move a localized heat source along the predefined line(s) by way of moving the heat source and/or carrier 26. Here, blank 24 having heat fusible materials incorporated into the blank in the region of the predefined line(s) would be simultaneously severed and fused such that a stable profile edge for the garment fabric is produced.

At fourth station 18, one or more components are applied to blank 24. Blank 24 can require additional garment parts, such as, for example, shoulder straps, and connecting means. Fourth station 18 is configured to secure such additional components to blank 24 while on carrier 26. The additional components can be positioned on blank 24 by a computer controlled robotic arm and then secured to the blank by means such as, for example, welding (heat or ultrasonic), or fusing, or application of adhesives.

Some fabrics used in the manufacture of blank 24 can be made using a colored yarn, which results in blank 24 having a desired color before being introduced to automated process 10. In addition, at least a portion of a colored pattern can be incorporated into the fabric of blank 20 by suitable manipulation of the pattern control of the knitting machine responsible for knitting the tubular blank in a known manner. These and other fabrics used in the manufacture of blank 24 can also be dyed in situ. Here, automated process 10 can further comprise fifth station 20 that provides blank 24 with a desired color and/or at least a portion of desired colored pattern. For example, fifth station 20 can apply a dye or other coloring agent in a selected pattern to blank 24. The desired pattern can cover all or parts of blank 24. By way of example only, fifth station 20 can use an ink jet printing process to apply the dye or other coloring agent to blank 24.

Accordingly, automated process 10 can include moving carrier 26 with blank 24 thereon to fifth station 20. At fifth station 20, blank 24 is dyed with a desired color over its entire surface and/or a desired pattern at selected surface areas of the fabric. If desired, fifth station 20 can print a pattern onto the surface of blank 24 using, for example, spray-printing techniques.

Fifth station 20 can apply the dye by way of a surface treatment technique in which the dye is applied to the surface of the fabric in a controlled manner, such as for example by a spraying technique, a rolling technique, and other known techniques. Alternately, fifth station 20 can apply the dye in an immersion technique in which blank 24 is immersed in a vat of dye. In addition, combinations of the aforementioned controlled and immersion techniques are contemplated by the present invention.

At sixth station 22, blank 24 is removed or discharged from carriage 26. Upon removal from carriage 26, blank 24 is either a fully finished garment or a nearly finished garment in that the blank has been set to the predetermined shape, has been trimmed to define the profile edges of the garment, and has been treated to provide the desired surface color/pattern of the garment. Thus, blank 24 is ready for further processing and or packaging.

The automated process 10 can, preferably, have additional stations as illustrated in FIG. 1. For example, process 10 can have a seventh station 32 (illustrated in phantom) and an eighth station 34 (also illustrated in phantom).

Seventh station 32 is positioned between first station 12 and second station 14. At seventh station 32, the fabric of blank 24 is exposed to a supply of steam or other gas, which can relax the yarns of the fabric prior to the processing at second station 14. For example, some fabrics used to manufacture blank 24 are known to retain a heat set shape better if the fabric is "relaxed", such as by steam, prior to being heat set. Thus, seventh station 32 is where the fabric of blank 24 can be relaxed, if needed, before being heat set at second station 14.

Eighth station 34 is positioned between fifth station 20 and sixth station 22. Eighth station 34 can clean blank 24 before being discharged from automated process 10 at sixth station 22. At eighth station 34, blank 24 can be cleaned to remove excess dye and other undesired contaminants. For example, eighth station 34 can wash and dry blank 24, can expose the blank to a dry cleaning operation, can expose the blank to other cleaning operations, or any combinations of one or more of the foregoing. It is also contemplated for blank 24 to be cleaned before fifth station 20 in order to remove contaminants before being dyed.

It should be recognized that automated process 10 can include any combination of the above referenced stations as required for the production of the desired garment. For example, some garments may not require the dyeing stations, others may not require the relaxing or heat setting stations, and still others may not require the parts application station. Thus, automated process 10 can be rapidly changed from producing one style of garment to another merely by way of the selection of the stations to which blank 24 is exposed. It should also be recognized that automated process 10 can be rapidly changed to modify the order of any combination of the above referenced stations as required for the production of the desired garment.

Automated process 10 can be controlled by way of a man-machine-interface (MMI) 36 in electrical communication with a controller 38, such as a programmable logic controller. Controller 38 controls the operation of each of station, as well as conveyor 30. Controller 38 can be programmed to have a number of different combinations of the stations, which an operator/user can select from via MMI 36. Thus, the operator can use MMI 36 to control the movement of blank 24 through the various stations of automated process 10 to provide selected processes to the blank, which produces a finished garment having the desired properties.

As described herein, automated process 10 is easily configurable to produce garments having a variety of attributes. Namely, automated process 10 is configurable to produce garments having various sizes, colors, styles, shapes, and the like. For example, each station 12, 14, 16, 18, 22, 32, 34 can be a separate module, which can be inserted into or removed from automated process 10, to permit the aforementioned configuration of the automated process.

Figure 2:
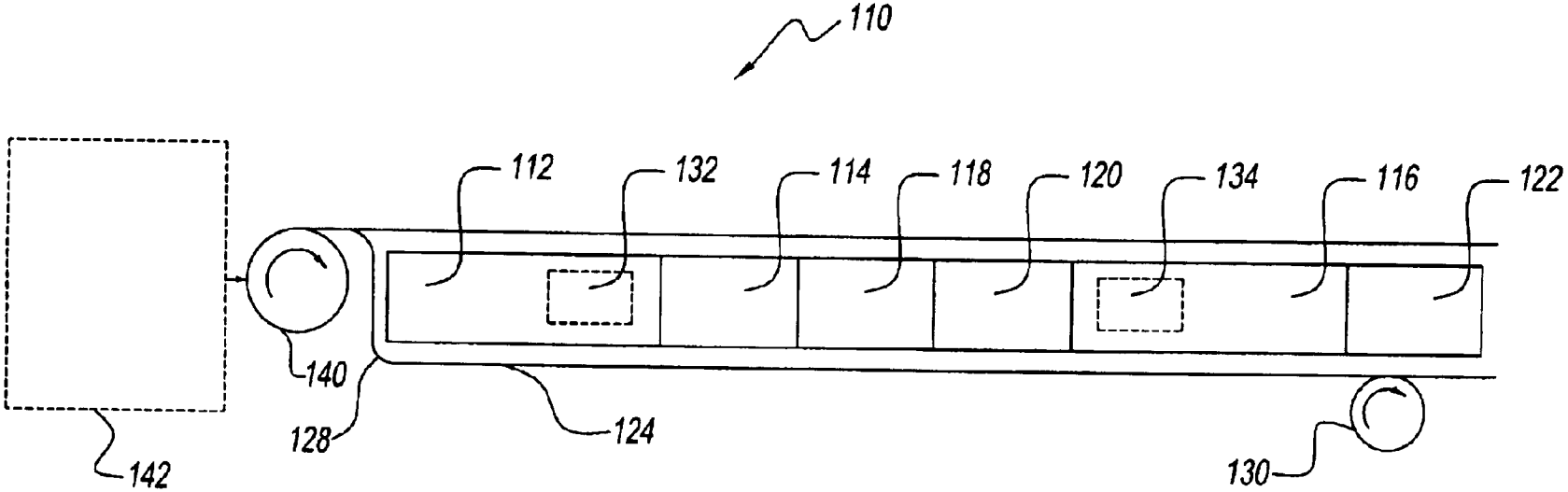
FIG. 2 is a schematic depiction of an alternate exemplary embodiment of an automated process.

Turning now to FIG. 2, an alternate exemplary embodiment of an automated process 110 is illustrated. Here, component parts performing similar or analogous features are numbered in multiples of one hundred. Again, automated process 110 includes a number or plurality of stations, where a separate manufacturing step of the finished garment can be performed at each station.

In the illustrated embodiment of automated process 110, the stations can include one or more of a first station 112, a second station 114, a third station 116, a fourth station 118, a fifth station 120, a sixth station 122, a seventh station 132, and an eighth station 134.

First station 112 feeds a continuous supply 128 of tubular blanks 124 onto a carrier 126 such that an inner dimension of continuous supply is supported by the carrier. Here, supply 128 has a number of discrete blanks 124, each having a different location along the length of the supply. Supply 128 can be in the form of a roll 140 of blanks, can be fed to automated process 110 directly from a knitting machine 142 (illustrated in phantom), or can be from a continuous roll of fabric produced on a knitting machine.

In this embodiment, carrier 126 is stationary and the supply 128 of blanks 124 is indexed or pulled along the carrier by an indexer or indexing means 130, which moves discrete portions of the blank to each of the stations. Again, garment blanks 124 remain on carrier 126 as the blanks move from station-to-station, an attribute that hereto for was unattainable. Of course, it is also contemplated for carrier 126 to move in combination with indexing means 130 pulling blanks 124 along the carrier.

Second station 114 heats set blank 124 to a desired shape. Here, carrier 126 can have a die (not show) removably and changeably disposed about the carrier in at least the region of second station 114. The die can have a predetermined shape. For example, in the case of producing brassieres, the die on carrier 126 can include a three-dimensional shape replicating the upper torso of a woman having predetermined chest and breast sizes.

It should be recognized that the die can have other desired shapes, such as a two-dimensional shape. In addition, it should be recognized that the die can be disposed about carrier 126 in the region of any of the stations of automated process 110.

Second station 114 can heat set blank 124 using any desired heat setting parameters (e.g., temperature, time, and the like) necessary for the fabric of the blank. Thus, blanks 124 made of different fabrics can be heat set at second station 114 merely by adjusting the heat setting parameters of the second station.

By way of example only, the heat can be applied to blank 124 at second station 114 by positioning a heating chamber (not shown) about the second station. Alternately, carrier 126 itself can, or can be configured to, apply heat to and/or remove heat from blank 124 at second station 114.

Since carrier 126 has a removable and changeable die, automated process 110 can be changed from manufacturing one garment having a first breast cup size to a second garment having a second breast cup size by merely replacing the die the carrier. Thus, automated process 110 can reduce the changeover time needed to change from garment-to-garment as compared to previous systems.

At fourth station 118, one or more components are trimmed to blank 124 while the blank is on carrier 126. Fifth station 120 provides blank 124 with a desired color and/or at least a portion of desired colored pattern. For example, fifth station 120 applies a dye or other coloring agent in a selected pattern to blank 124. The desired pattern can cover all or parts of blank 124.

At third station 116, one or more regions from blank 124 are trimmed to define the periphery of the finished garment. Third station 116 can trim blank 124 in any manner necessary. For example, third station 116 trims blank 124 through the application of heat to the heat degradable yarns incorporated in blanks 124 to thereby define the outer periphery of the finished garment, through physically severing the fabric of the blank with a blade, through localized heat cutting of the blank, through ultrasonic means, lasers, or through combinations of one or more of the foregoing. Since it is desired to maintain blank 124 as a continuous supply of blanks, third station 116 preferably is disposed at the end of carrier 126.

At sixth station 122, blank 124 is removed or discharged from carriage 126. Upon removal from carriage 126, blank 124 is either a fully finished garment or a nearly finished garment in that the blank has been set to the predetermined shape, has been trimmed to define the profile edges of the garment, and has been treated to provide the desired surface color/pattern of the garment. Thus, blank 124 is ready for further processing and or packaging.

In some embodiments, automated process 110 can also include seventh station 132 and eighth station 134 (illustrated in phantom). At seventh station 132, the fabric of blank 124 is exposed to a supply of steam or other gas, which can relax the yarns of the fabric prior to being heat set at second station 114. At eighth station 34, blank 124 is cleaned before being discharged from automated process 110 at sixth station 122.

Again, automated process 110 can include any combination of the above referenced stations as required for the production of the desired garment, and these stations are preferably configured to achieve the purpose of each station set forth above. For example, some garments may not require the dyeing stations, others may not require the relaxing or heat setting stations, and still others may not require the parts application station. Thus, automated process 110 can be rapidly changed from producing one style of garment to another merely by way of the selection of the stations to which blank 124 is exposed.

Further, the term "station" as used herein with respect to automated processes 10, 110 does not necessarily mean that blanks 24, 124, carriers 26, 126, or conveyors 30, 130 are stationary while a particular operation is carried out. For example, one or more of the finishing-type operations of automated processes 10, 110 can be performed "on the fly" or while the garment is moving among the stations. Thus, it should be recognized that automated processes 10, 110 are described herein by way of example and for purposes of clarity only as including several discrete stations. Accordingly, one or more of the stations can overlap in space and/or in time as needed.

The present processes 10, 110 provide an automated system in which preferably all, or virtually all, operations or steps for forming a finished garment are performed in a sequenced, non-manual process. Moreover, all operations are performed on a model that can represent the shape of the user of the garment.

It should also be noted that the terms "first", "second", and "third" and the like may be used herein to modify various elements. These modifiers do not imply a spatial, sequential, or hierarchical order to the modified elements unless specifically stated.

While the invention has been described with reference to one or more exemplary embodiments, it will be understood by those skilled in the art that various changes may be made and equivalents may be substituted for elements thereof without departing from the scope of the invention. In addition, many modifications may be made to adapt a particular situation or material to the teachings of the disclosure without departing from the essential scope thereof. Therefore, it is intended that the invention not be limited to the particular embodiment(s) disclosed as the best mode contemplated for carrying out this invention, but that the invention will include all embodiments falling within the scope of the appended claims.

What is claimed is:

1. An automated process comprising:

loading a circularly knit blank on a carrier, said carrier having at least a portion with a desired shape and providing said blank with a stretched condition;

moving said carrier to more than one of a plurality of stations; and performing an operation on said circularly knit blank while said circularly knit blank is loaded on said carrier at said plurality of stations to define a substantially finished garment.

2. The automated process of claim 1, wherein said plurality of stations is two or more stations selected from the group consisting of a fabric relaxation station, a heat setting station, a trimming station, a component application station, a dyeing station, and a cleaning station.

3. The automated process of claim 2, wherein moving said carrier to more than one of said plurality of stations produces a modified blank.

4. The automated process of claim 1, further comprising discharging said substantially finished garment from said carrier.

5. The automated process of claim 1, wherein moving said carrier to more than one of said plurality of stations comprises moving a conveyor having said carrier removably mounted thereto.

6. The automated process of claim 2, wherein said circularly knit blank comprises heat degradable yarns in said circularly knit blank.

7. The automated process of claim 6, wherein said trimming station heats said circularly knit blank so that said heat degradable yarns is degraded to cause separation of said circularly knit blank.

8. The automated process of claim 6, wherein said trimming station applies a localized heat source to said heat degradable yarns to simultaneously sever and fuse said circularly knit blank.

9. An automated process comprising:

loading a circularly knit garment blank on a carrier, said carrier having at least a portion with a desired shape and providing said circularly knit garment blank with a stretched condition; and performing a plurality of garment blank modifying operations on said circularly knit garment blank while said circularly knit garment blank is loaded on said carrier to define a substantially finished garment.

10. The automated process of claim 9, wherein said plurality of garment blank modifying operations is two or more modifying operations selected from the group consisting of a fabric relaxation operation, a heat setting operation, a trimming operation, a component application operation, a dyeing operation, and a cleaning operation.

11. The automated process of claim 10, wherein said trimming operation comprises applying heat to said circularly knit garment blank.

12. The automated process of claim 11, wherein said heat is applied by an ultrasonic means or a laser.

13. The automated process of claim 11, wherein heat is applied in an amount sufficient to cause yarns of said circularly knit garment blank to separate and define a desired periphery.

14. The automated process of claim 10, wherein said fabric relaxation operation comprises exposing said circularly knit garment blank to a supply of steam or other gas.

15. The automated process of claim 9, wherein each of said plurality of garment blank modifying operations is performed at a station.

16. The automated process of claim 15, further comprising moving said carrier to said station while said circularly knit garment blank is loaded on said carrier.

17. The automated process of claim 15, further comprising moving said circularly knit garment blank to said station while said garment blank is loaded on said carrier.

18. The automated process of claim 9, further comprising unloading said substantially finished garment from said carrier after performing said plurality of garment blank modifying operations.

19. An automated process comprising:

defining a plurality of discrete blanks in a supply of circularly knit fabric;

loading said supply of circularly knit fabric on a carrier;

moving said supply of circularly knit fabric over said carrier so that each of said plurality of discrete blanks moves to a plurality of stations; and performing a garment finishing operation on said supply of circularly knit fabric at said plurality of stations so that a plurality of substantially finished garments are produced.

20. The automated process of claim 19, wherein said plurality of stations is two or more stations selected from the group consisting of a fabric relaxation station, a heat setting station, a trimming station, a component application station, a dyeing station, and a cleaning station.

21. The automated process of claim 19, further comprising separating each of said plurality of discrete blanks from said supply of circularly knit fabric.

22. The automated process of claim 21, further comprising discharging said plurality of substantially finished garments from said carrier.

* * * * *